US012790771B2

(12) United States Patent
Weiser et al.

(10) Patent No.: US 12,790,771 B2
(45) Date of Patent: Nov. 10, 2026

(54) ROAD FINISHING MACHINE WITH A HEATING DEVICE AND METHOD

(71) Applicant: JOSEPH VOEGELE AG, Ludwigshafen/Rhein (DE)

(72) Inventors: Ralf Weiser, Ladenburg (DE); Michael Heindtel, Mannheim (DE); Steffen Kost, Bad Dürkheim (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 1155 days.

(21) Appl. No.: 17/810,940

(22) Filed: Jul. 6, 2022

(65) Prior Publication Data

US 2023/0009241 A1 Jan. 12, 2023

(30) Foreign Application Priority Data

Jul. 7, 2021 (EP) ..... 21184236

(51) Int. Cl.
*E01C 19/42* (2006.01)

(52) U.S. Cl.
CPC ..... *E01C 19/42* (2013.01); *E01C 2301/10* (2013.01)

(58) Field of Classification Search
CPC ..... E01C 19/42; E01C 19/48; E01C 2301/10; E01C 19/4866
See application file for complete search history.

(56) References Cited

U.S. PATENT DOCUMENTS 6,334,735 B1 * 1/2002 Williams ..... E01C 19/48 700/19
10,280,572 B1 5/2019 Thiesse
10,934,921 B2 * 3/2021 Culbertson ..... F01N 13/0097
2009/0257825 A1 * 10/2009 Nelson ..... H05B 1/023 404/95

(Continued)

FOREIGN PATENT DOCUMENTS

CN 110485239 A1 11/2019
CN 218492219 U 2/2023

(Continued)

OTHER PUBLICATIONS

Joseph Voegele AG, DE20305577U1 (English Translation) (Year: 2004).*

(Continued)

*Primary Examiner* — Jonathan L Sample
*Assistant Examiner* — Abigail Lee Espinoza
(74) *Attorney, Agent, or Firm* — BROOKS KUSHMAN P.C.

(57) ABSTRACT

A road finishing machine is described having a screed embodied or configured to produce a road pavement and having a heating device with multiple heating elements. The road finishing machine may furthermore include at least one generator for supplying the heating device with electrical power. The road finishing machine moreover has a controlling system embodied or configured to activate the generator. The heating elements each have at least one temperature sensor employed for detecting a malfunction occurring thereat. The disclosure furthermore relates to a method for detecting a malfunction of a heating element installed within a screed of a road finishing machine.

17 Claims, 3 Drawing Sheets

(56) References Cited

U.S. PATENT DOCUMENTS

| | | | | |
|---|---|---|---|---|
| 2014/0035555 | A1* | 2/2014 | Eul | H04L 61/5038 324/71.1 |
| 2015/0361626 | A1 | 12/2015 | Trox et al. | |
| 2016/0061755 | A1* | 3/2016 | Delius | G01N 33/42 374/43 |
| 2016/0289902 | A1 | 10/2016 | Eul et al. | |
| 2017/0071030 | A1 | 3/2017 | Schlipf | |
| 2017/0287236 | A1 | 10/2017 | Carlson | |
| 2018/0282952 | A1* | 10/2018 | Buschmann | E01C 19/48 |
| 2019/0047569 | A1 | 2/2019 | Achmann et al. | |
| 2019/0136466 | A1 | 5/2019 | Thiesse | |
| 2019/0257041 | A1* | 8/2019 | Heindtel | E01C 19/48 |

FOREIGN PATENT DOCUMENTS

| | | | | |
|---|---|---|---|---|
| DE | 20305577 | U1 * | 8/2004 | E01C 19/48 |
| DE | 202015104723 | U1 | 9/2015 | |
| DE | 102015012298 | A1 | 3/2017 | |
| EP | 1295990 | A2 | 3/2003 | |
| EP | 3051024 | A1 | 8/2016 | |
| EP | 3075909 | A1 | 10/2016 | |
| EP | 3527721 | A1 | 8/2019 | |
| JP | 2019143465 | A | 8/2019 | |
| WO | 2014/124545 | A1 | 8/2014 | |

OTHER PUBLICATIONS

CNIPA Search Report for CN Application No. 2022108531183, dated Jan. 20, 2025, 7 pages (including English translation).
CNIPA First Office Action in CN Application No. 2022108531183, dated Jan. 21, 2025 (10 pages, including English translation).
European Search Report dated Jan. 7, 2022, Application No. 21184236.4-1002, Applicant Joseph Voegele AG, 10 Pages.
JPO Office Action in JP Application No. 2022-108301 dated Jan. 21, 2026 (13 pages, including English translation).

* cited by examiner

ROAD FINISHING MACHINE WITH A HEATING DEVICE AND METHOD

CROSS-REFERENCE TO RELATED APPLICATION

This application claims foreign priority benefits under 35 U.S.C. § 119(a)-(d) to European patent application number EP 21184236.4, filed Jul. 7, 2021, which is incorporated by reference in its entirety.

TECHNICAL FIELD

The present disclosure relates to a road finishing machine with a heating element and a method thereof.

BACKGROUND

Road finishing machines are configured to produce a road pavement from hot bituminous laying material. For (pre-) compacting the laying material, road finishing machines have a screed that is pulled thereat into the direction of the laying drive and is maintained at a desired working temperature by means of a heating device integrated therein. The heating device comprises a plurality of heating elements, for example heating rods, which are installed in the respective screed sections to heat compaction aggregates installed therein and compactor plates directed towards the ground. The heating device is supplied with electrical power by a generator of the road finishing machine.

The paving result depends, among other things, on the operability of the heating elements installed in the screed body. It is therefore desirable to monitor, during the paving operation, the operation of the heating elements to possibly detect a defective heating element as quickly as possible and to replace it by an operable heating element.

EP 3 527 721 A1 discloses a road finishing machine with power adapters for electric screed heating devices.

EP 1 295 990 A2 discloses a closed-loop control device for heating elements installed at the screed of a road finishing machine.

WO 2014/124545 A1 discloses a method for heating a screed of a road finishing machine equipped with a heating device, wherein the electric voltage which is supplied to a heating element of the heating device is changed to change the heating power of the heating device.

DE 10 2015 012 298 A1 discloses a road finishing machine with a generator that supplies an electric screed heating of a screed of the road finishing machine with electric energy. The screed heating comprises a plurality of groups of heating elements associated with various functional components of the screed, e. g. a bottom plate, a tamper etc. Furthermore, a current meter device is provided which is embodied to measure an output current of the generator and which communicates with the machine control via a data bus. Based on the current measurement, a diagnosis of errors can be performed for the screed heating. Based on this diagnosis of errors coupled to the power supply, it is, however, difficult to determine individual defective heating elements, in particular their place of installation, so that repair works can be cumbersome. This can result in extended downtimes of the road finishing machine on site.

DE 20 2015 104 723 U1 discloses an electric heating cartridge with an integrated temperature control.

SUMMARY

It is the object of the disclosure to provide a road finishing machine and a method by which the operation of a screed heating device of the road finishing machine can be better monitored by means of simple constructive technical features.

This object is achieved by a road finishing machine and a method shown and described in detail herein.

Advantageous developments of the disclosure are also described in detail herein.

The road finishing machine according to the disclosure includes a screed embodied or configured to produce a road pavement and comprising a heating device with a plurality of heating elements. The road finishing machine according to the disclosure furthermore may include at least one generator for supplying the heating device with electrical power and/or a controlling system embodied or configured to activate the generator.

According to the disclosure, the heating elements each comprise at least one temperature sensor employed for detecting a malfunction occurring at them. Based on the temperature measurements performed each directly at the heating elements, a malfunction can be detected individually, i. e. of one or several certain heating elements of the heating elements employed within the screed.

The heating elements employed according to the disclosure are each embodied or configured to detect a temperature directly occurring at them during the operation of the road finishing machine, so that the respective temperature conditions of these heating elements are continuously precisely detected and can be forwarded to the controlling system for detecting a possible malfunction. Thereby, the function of all heating elements having a temperature sensor at the screed can be individually monitored. This has the advantage that defective heating elements can be quickly identified and replaced which can make a considerable contribution to the production of high-quality road pavements. Moreover, by means of the temperature-based diagnosis device according to the disclosure, downtimes of the road finishing machine can be drastically reduced.

In particular, the disclosure permits to carry out a continuous determination of malfunctions based on the temperature measurements carried out directly at the heating elements, independent of any power supply of the respective heating elements, which is optionally performed at intervals.

In an advantageous variant, the temperature sensor is connected to the controlling system by a gateway configured for signal processing. This is perfectly suited as a functional module for connecting the heating elements to the controlling system for the purpose of the diagnosis of errors and could also coordinate a power distribution to the respective heating elements. It is possible for the temperature sensor to be connected to a screed distributor designed to receive and transmit actual temperature values detected by the temperature sensor. Although it can be primarily used for power distribution, the screed distributor can also transmit the respective actual temperature values of the heating elements to the controlling system as a functional coupling unit, so to speak as a transceiver.

It would be useful for the screed distributor to be embodied or configured to forward the actual temperature values of the respective heating elements received thereat to a gateway configured for signal processing and connected to the controlling system. As a central gateway, this gateway can receive all the measuring signals detected at the screed, in particular the actual temperatures of the respective heating elements, from the screed distributor, and can optionally forward them, in a processed form, to the controlling system for the respective open-loop and/or closed-loop control sequences executed in it, especially for the error diagnosis function.

According to one embodiment, the screed has a plurality of screed sections, each having a plurality of heating elements as well as a gateway configured for signal processing that connects the temperature sensors provided at it to the controlling system. As an alternative, the respective screed sections each have a plurality of heating elements as well as one screed distributor each.

The gateway and/or the screed distributor is in particular designed as a hardware and/or software component that establishes a connection between the respective heating elements and the controlling system. In particular, the screed distributor is configured as a transceiver to receive the temperature conditions continuously measured at the respective heating elements during the operation of the road finishing machine and to send them to the gateway. The gateway can provide the respective temperature data received by the screed in such a form to the controlling system that it checks based thereon the operability of the respective heating elements.

The gateway and/or the screed distributor is in particular configured to connect the heating elements installed within the screed to the controlling system at least for a precise error diagnosis function. The individual temperature values measured at the individual heating elements and received at the gateway or at the screed distributor can be forwarded to the controlling system by means of the gateway and/or by means of the screed distributor in a data-processed form such that it can perform, based thereon, an individual diagnosis of errors for the individual heating elements. The gateway and/or the screed distributor accordingly serves, for the temperature-based error diagnosis function, as a central interface embodied for data processing between the temperature sensors installed in the screed body at the respective heating elements and the controlling system.

The gateway and/or the screed distributor may moreover offer the function of bringing the respective temperature measuring signals received thereat into a data form suited for open-loop and/or closed-loop processes of the operation of the screed and forwarding them to the controlling system, based on which in particular compacting units of the screed can be dynamically activated.

The screed may include a plurality of screed sections which each include a plurality of heating elements and each a gateway configured for signal processing and connecting the temperature sensors provided thereat with the controlling system, or which each include a plurality of heating elements and a screed distributor connecting the temperature sensors connected to it with the gateway. This screed distributor can precede the gateway as a transceiver.

It is conceivable for the screed to include three or more screed sections, that is a central basic screed and extendable parts laterally mounted thereat which can be extended for varying the pavement width transverse to the direction of the laying drive of the road finishing machine. In a variant, further screed sections in the form of broadening parts can be attached to the extendable parts of the screed for producing large pavement widths. By each of the aforementioned screed sections including a separate gateway or at least a separate screed distributor for the heating elements installed therein, the respective heating elements installed in the screed sections can be separately monitored and/or activated based on the respective heating conditions measured thereat.

Above all, the respective gateway or the respective screed distributor can be embodied as an integral part of the screed, in particular the respective screed sections. Each screed section can be equipped with a separate gateway or with a separate screed distributor which receives, during the operation of the road finishing machine as a central data receiver unit at the respective screed section, individual sensor measured values, mainly the temperature measuring signals of the respective heating elements, and forwards them, optionally in a further processed form, to the controlling system for a certain function, in particular for the temperature-related error diagnosis function. The respective gateways or screed distributors integrally installed in the screed thereby form data receiver and data transmitter modules which precede the controlling system to forward the measured temperature values received thereat to the controlling system, optionally in a data-processed form, for the aforementioned temperature-related error diagnosis function.

The temperature sensors may be embodied at the respective heating elements in an integrated way. Thereby, the respective heating element and the temperature sensor structurally form a unit whereby the heating element can be easily installed and deinstalled together with the temperature sensor as a compact unit. This offers considerable advantages mainly in repair and/or service works. Therefore, the respective heating elements have an input for power supply and an output for the temperature detection performed thereat.

The respective heating elements can include, for example, a hot, cold and/or semiconductor temperature sensor. The respective heating elements can be embodied as heating rods. The temperature sensors can extend corresponding to the geometry of the heating rods along heating coils provided therein.

In particular, all heating elements of the heating device include at least one temperature sensor integrally formed thereat. It is thereby possible to perform very precise temperature measurements at all heating elements installed within the screed. Based thereon, on the one hand, the function of the respective heating elements can be precisely diagnosed, and on the other hand, the respective heating elements can be precisely activated.

It is advantageous for the temperature sensors to each be connected to the gateway or to the screed distributor by means of a plug connection. In particular, this plug connection can be configured for an installation and deinstallation without tools so that the respective heating elements can be easily connected and deinstalled individually.

It is conceivable for the respective temperature sensors to be connected with the gateway or be connected to the screed distributor via a common bus system. This network could be connected to the gateway or to the screed distributor by means of one single plug connection. Thereby, the amount of cabling within the screed can be reduced.

According to one embodiment of the disclosure, the gateway or the screed distributor of the respective screed sections is directly embodied as a Power Line Communication (PLC) gateway. For the screed, improved possible applications offer themselves thereby, both with respect to construction and function. In particular, despite increasing sensory mechanisms, a constructive design of the screed can be thereby designed to be more compact, and/or an operational behavior of the screed can be better monitored and controlled.

As a PLC gateway, the gateway or the screed distributor embodied as a PLC gateway can modulate the temperature measuring signals received from the respective heating elements to a power line connected therewith via which the modulated temperature measurement data can be transmitted to the controlling system. It is conceivable that the power line employed for data transport for this is formed at least of one section of a power supply line employed for the power supply of the respective heating elements and/or the respective PLC gateway.

In a variant of the disclosure, the respective PLC gateway is connected with the controlling system by means of a PLC line (supply line for Powerline Communication). As the PLC line, a power supply line connected from the generator with the screed would be possible, for example, at least in sections. Above all, a power supply line which provides the respective heating elements with electrical power can be employed as the PLC line. The PLC gateway can be directly connected to such a PLC line, so that it functions as a power distributor in the direction to the heating elements and modulates temperature measurement data on the PLC line in the direction to the controlling system as a PLC gateway.

As an alternative to the PLC line or as a supplement to it, the gateway can be connected with the controlling system by means of a separate data bus system. The data bus system can be embodied, for example, as a CAN bus or as an ethernet connection.

It is conceivable that the (PLC) gateway is configured as an Internet gateway in order to perform, except for the transmission of the temperature measurement data to the controlling system of the road finishing machine, a supplementary transfer of temperature measurement data taking place at least temporarily during the paving operation of the road finishing machine, to at least one external receiver connected via the Internet, for example a transfer of temperature measurement data to a central construction site administration facility, a service center and/or another construction vehicle cooperating with the road finishing machine.

It would be possible for the (PLC) gateway to be embodied as a VPN gateway so that the gateway embodied in this manner can be queried for malfunctions of the heating elements and/or activated in a data-protected manner in particular from outside the construction site, for example from a service center. This can be a service center operated by the manufacturer of the machine which can transmit, on the basis of the VPN connection installed with the screed, service information for the respective screed section to the operator of the construction site. Thereby, machine downtimes on the construction site can be reduced.

It is conceivable that the (PLC) gateway is configured as a media gateway. Configured in such a way, the gateway could further process the respective temperature conditions of the heating elements received thereat, in particular critical temperature conditions measured thereat, into corresponding voice output signals which are acoustically transmitted to an operator of the road finishing machine, in particular an operator of an external control platform of the screed, during the paving operation.

A simple, while very practicable variant provides that the gateway and/or the screed distributor of the respective screed sections includes, for all heating elements installed therein, a separate lamp embodied for the optical display of the operability of the respective heating elements.

In an advantageous embodiment, the controlling system is embodied or configured to identify, on the basis of respective temperature gradients detected by means of the temperature sensors formed at the heating elements, that means in view of a march of temperature within a predetermined period detected thereat, a respective heating element type of the heating elements, and to determine, for the respective identified heating element types, one determined desired temperature value each based on which the temperature-based error diagnosis function can be performed.

For example, the controlling system is embodied, for carrying out the error diagnosis function, to compare the respective desired temperature values determined for the heating elements with actual temperature values detected thereat. If the detected actual temperature of a heating element here reaches or exceeds the desired temperature determined for this heating element, the function of the heating element is in order. If, however, the controlling system detects that the detected actual temperature of the heating element falls below the desired temperature determined for it by a predetermined value, the heating element can be defective. Such a malfunction can be displayed to an operator at the external control platform of the road finishing machine at a display provided thereat.

It is convenient for the controlling system to be embodied or configured to identify, on the basis of at least one determined heating element type, a screed part which includes it. For example, by means of the identified heating element type, the type of a broadening part attached for the pavement could be determined. In particular, the controlling system is embodied or configured to determine, on the basis of the determined heating element types, mainly on the basis of the respective types of the attached broadening parts identified thereby, a screed paving width. The controlling system can employ, as described above, the determined screed pavement width for various open- and closed-loop control processes executed at the road finishing machine.

In one embodiment, the gateway and/or the screed distributor is configured to supplement actual temperature values of the heating elements detected by means of the respective temperatures sensors each by at least one piece of information with respect to their place of measurement and to forward them to the controlling system as actual temperature-place data. It is thereby possible to clearly identify a defective heating element with respect to its place of installation and to swiftly exchange it, so that the paving operation of the road finishing machine can be carried out without any major interruptions.

An operability of the respective heating elements may be displayed to an operator of the screed and/or a driver of the road finishing machine by means of a display device connected to the controlling system. This can be accomplished in particular visually and/or acoustically. It is conceivable that the operability of the respective heating elements can be displayed on a portable display and/or computer unit, for example, on a portable operation unit of the external control platform.

In one advantageous embodiment, the screed comprises at least one screed plate, wherein the controlling system is configured to determine a desired temperature value of the screed plate on the basis of a detected actual temperature value of the laying material used by the road finishing machine for producing a road pavement supplied to it, and to compare it with a detected actual temperature of the screed plate in order to activate, based thereon, a power supply of the heating element(s) associated with the screed plate. To detect the actual temperature of the screed plate, the screed plate can include at least one temperature sensor which is directly connected to the screed distributor or to the gateway. It would be conceivable for the desired temperature value of the screed plate to be manually adjustable at the road finishing machine.

In one advantageous embodiment, the controlling system is configured to determine, on the basis of a detected ambient temperature supplied to it, a heating duration remaining for achieving the desired temperature value of the screed plate of the heating element or elements employed for heating the screed plate, optionally identified in advance via its temperature gradient. Based thereon, an optimal starting time for the pavement drive could be determined.

It would be possible for the controlling system to be configured to check the operability of the respective heating elements in that by a predetermined power supply of the respective heating elements, the actual temperature values detected thereat will reach the ambient temperature supplied to the controlling system within a predetermined period, for example, within one minute, or will exceed it by a predefined amount.

It is advantageous for the controlling system to be embodied or configured to determine, based on a detected duration required for heating a heating element to a predetermined temperature level, a type of the heating element and/or a type of the associated screed section, for example the type of a broadening part. Thereby, a constructive design of the screed, in particular a type of the respective screed sections employed thereat, could be indirectly determined via the individually detectable heating duration of at least one heating element.

According to one embodiment, it is possible for the controlling system to be embodied or configured to determine, based on a detected operating temperature of a heating element appearing after a predetermined heating period, a type of the heating element and/or a type of the associated screed section, for example the type of a broadening part.

The controlling system may be configured to determine, on the basis of an aforementioned type determination of the heating element and/or a type determination of the screed section, a screed pavement width adjustable for the pavement operation. According to one embodiment of the disclosure, the screed pavement width determined by means of the controlling system on the basis of the temperature measurement performed at the heating element can be stored as an input quantity for at least one open-loop and/or closed-loop control function of the screed of the road finishing machine. For example, based on this, a controlled variable and/or a control parameter for activating the operation of a material transverse distributor device of the screed can be dynamically adjusted. The screed construction derived from the temperature measurement can thus serve for a parameterization of the controlling system, e. g. for controlling the material distribution in front of the screed.

In one variant, the controlling system is designed to determine a minimum temperature of the laying material stored within a material bunker of the road finishing machine based on the typification of the heating elements and/or the screed sections derived from the heating duration. The minimum temperature could, according to an embodiment, directly be displayed to the driver of the road finishing machine and/or be transmitted from the controlling system of the road finishing machine to a mixer for producing the laying material provided for the road finishing machine.

According to an advantageous variant, information in view of an operation of the respective heating elements, for example their respective operating temperatures and/or their places of installation, can be represented by means of a display device arranged at the road finishing machine. The display device can be embodied as part of the controlling system, for example as a display at the driver control platform and/or as a display at the external control platform of the screed. A representation of the operating temperatures and/or of the heating element diagnosis result on a smart device would also be conceivable. By means of such display devices, in case of a detected defective heating element, matching installation and deinstallation instructions could be represented.

The disclosure furthermore relates to a method for detecting a malfunction of at least one heating element installed within a screed of a road finishing machine. According to the disclosure, the detection of the malfunction is performed on the basis of an actual temperature value directly detected at the heating element. For this diagnosis function, the actual temperature value of the heating element can be detected by means of a temperature sensor integrated therein and be forwarded to a controlling system which can very precisely determine a malfunction of the heating element based thereon, if present.

It is conceivable that during the operation of the road finishing machine, all heating elements installed within one screed are continuously or at least temporarily checked for a malfunction on the basis of respective actual temperature values detected thereat. For this, the respective actual temperature values of all heating elements are detected by means of temperature sensors integrated therein.

In one variant, depending on a temperature gradient detected at the heating element, i. e. a heating rate of the heating element, a heating element type of the heating element is identified, and a desired temperature value suited for the purpose of the malfunction diagnosis is determined in view of the identified heating element type for the heating element, wherein the detecting of the malfunction is accomplished by means of a comparison of the desired temperature value with the actual temperature value directly detected at the heating element. If the detected actual temperature of a heating element here reaches or exceeds the desired temperature determined for this heating element, the function of the heating element is in order. If, however, the controlling system detects that the detected actual temperature of the heating element falls below the desired temperature determined for it by a predetermined value, the heating element can be defective. Such a malfunction can be indicated to an operator at the external control platform of the road finishing machine at a display provided thereat.

The actual temperature value of the heating element or elements may be transmitted to a controlling system of the road finishing machine by means of a screed distributor and/or gateway connected with the temperature sensor. The screed distributor and/or the gateway thus receives the respective heating conditions of the heating elements and forwards them to the controlling system, mainly for diagnosis purposes, optionally in a data-processed form. By means of these temperature measurements directly performed in the heating element, their function can be diagnosed more precisely.

It is possible for the screed distributor and/or the gateway to supplement the actual temperature value of the heating element detected by means of the temperature sensor by a piece of information with respect to its place of measurement and to forward it to the controlling system as an actual temperature-place value. This permits to clearly identify an optionally defective heating element with respect to its place of installation within the screed.

By switching on the heating device, the heating elements can each heat up to a remaining actual (final) temperature which is higher than a temperature of the laying material. The controlling system suitably continuously compares the actual temperature values of the respective heating elements with the desired temperature values determined for them during the operation of this screed. As long as the actual temperature of the respective heating elements is higher or equal to the respective desired temperature, the heating elements operate correctly. However, as soon as, after the lapse of a predetermined heat-up phase, the actual temperature of a heating element falls below the associated desired temperature value by a defined temperature value, this heating element can be defective. This defect can be displayed to the operator by means of a display device. As an alternative or a supplement to the display of a defective heating element by means of the display device, it is suitable for the controlling system to be configured to switch off the heating element detected as defective, i. e. to interrupt a power supply to this heating element to prevent a damage of the heating device.

It is conceivable that additionally, the place of the heating element detected as defective is displayed. This can be done by the screed distributor and/or the gateway forwarding the actual temperature value present for the malfunction to the controlling system, supplemented by its sender address. From this, the controlling system can precisely identify the defective heating element. In one variant, a defective heating element is displayed by means of a status LED formed at the screed distributor and/or at the gateway.

It would be possible for the controlling system to perform a determination of type based on a heat-up rate of the heating element measured at the heating element, and optionally a determination of type of the screed section based thereon, depending on which the controlling system determines the adjustable screed pavement width of the screed and/or the screed pavement width currently adjusted during the paving operation. By means of the determined screed pavement width, further processes at the road finishing machine, in particular a transverse material distribution in front of the screed, can be controlled by open-loop or closed-loop control.

BRIEF DESCRIPTION OF THE DRAWINGS

The disclosure will be described more in detail with reference to the following figures. In the drawing.

Figure 1:
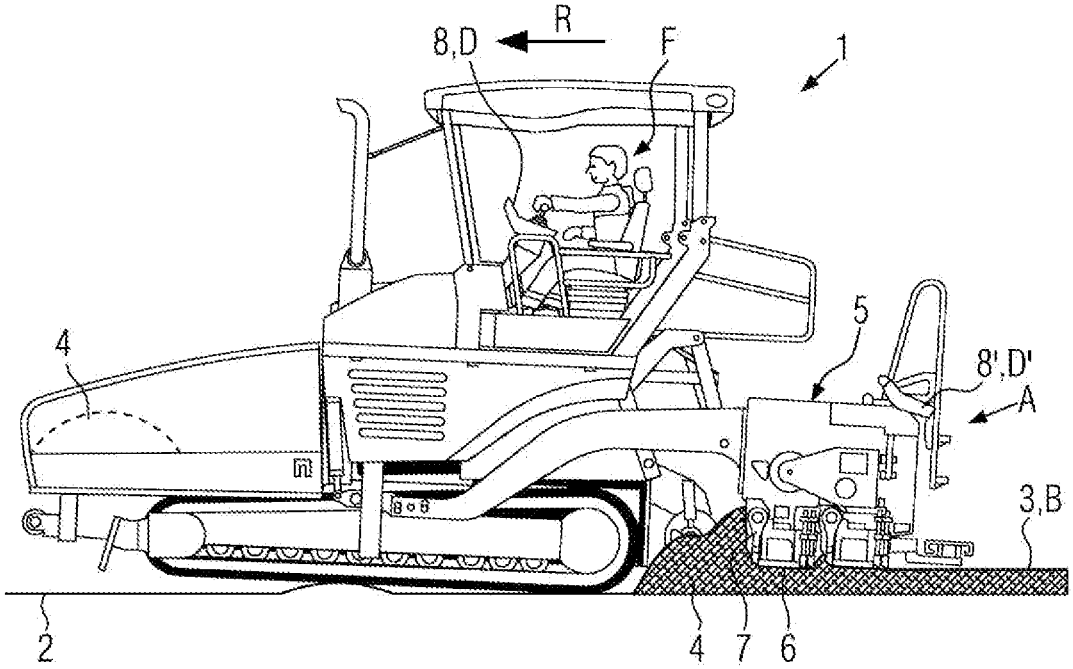
FIG. 1 shows a road finishing machine according to the disclosure.

Equal components may be provided with equal reference numerals in the figures.

DETAILED DESCRIPTION

FIG. 1 shows a road finishing machine 1 which produces, in the direction of the laying drive R, a road pavement 3 from a laying material 4 by means of a screed 5 on a subsoil. The road pavement 3 has a screed pavement width B transverse to the direction of the laying drive R produced corresponding to the screed configuration. The screed 5 is embodied or configured to compact the laying material 4 spread in front of it. The screed 5 includes a screed plate 6 as well as a tamper 7 arranged in front of the screed plate 6 in the direction of the laying drive R.

The road finishing machine 1 of FIG. 1 has a driver control platform F for a driver. On the driver control platform F, a controlling system 8 is provided. The controlling system 8 is configured to control and/or monitor processes executed at the road finishing machine 1. In particular, by means of the controlling system 8, the operation of the screed 5 can be controlled and its operation monitored.

FIG. 1 furthermore shows that an external control platform A with a controlling system 8' embodied thereat is embodied at the screed 5. By means of the controlling system 8', a screed operator can control and/or monitor the operation of the screed 5 at the external control platform A. The controlling system 8 installed on the driver control platform F and/or the controlling system 8' installed at the screed 5 at the external control platform A can be embodied as a display device D, D' to display respective process states of the road finishing machine 1 to the driver and/or the screed operator.

Figure 2:
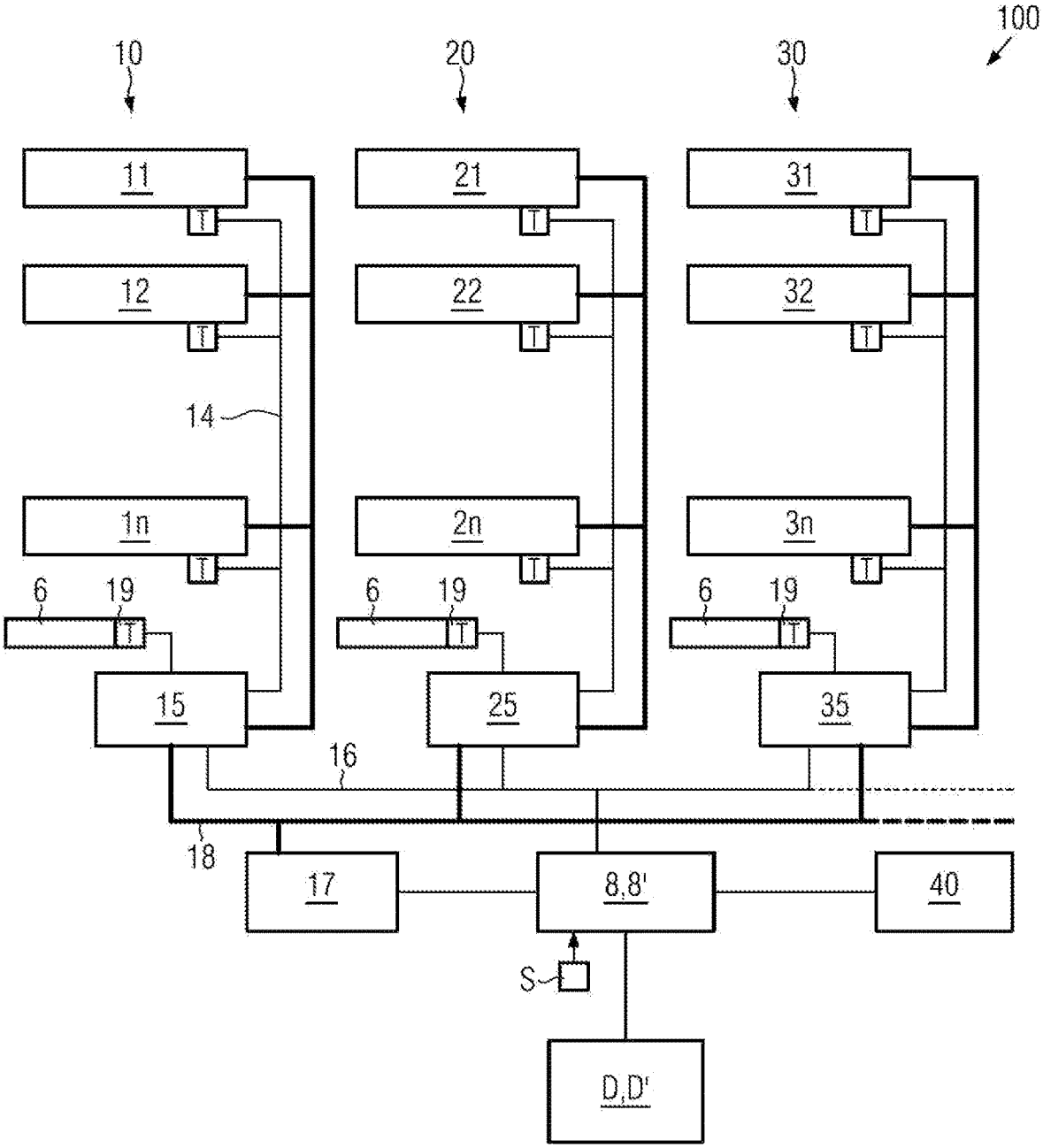
FIG. 2 shows a schematic representation of a heating device according to the embodiment for the road finishing machine according to the disclosure.

FIG. 2 shows a heating device 100 for the road finishing machine shown in FIG. 1 in a schematic representation. The heating device 100 is embodied or configured to heat the screed 5. FIG. 2 shows that the heating device 100 includes a plurality of screed segments 10, 20, 30. The screed section 10 can be a basic screed section. The two screed sections 20, 30 can be extendable screed parts laterally fixed to the screed section 10. The construction of the shown heating device 100 could include further screed sections which are not shown in FIG. 2, for example, screed broadening parts, optionally in different widths and/or numbers, which are laterally attached to the extendable screed parts.

The screed section 10 has a plurality of heating elements 11, 12, 1*n*, which each include a temperature sensor T integrally installed thereat. The temperature conditions of the respective heating elements 11, 12, In detected by means of the temperature sensors T can be forwarded to a gateway 15 in the screed section 10 by means of a signal line 14. The gateway 15 is configured to bring the respective temperature conditions of the heating elements 11, 12, In into a data form processed for diagnosis purposes. These data are forwarded from the gateway 15 by means of a data line 16, for example a CAN bus system, to the controlling system 8, 8' for diagnosis purposes and optionally other control functions.

The controlling system 8, 8' is functionally connected to a generator 17 and can activate an operation thereof based on the data received from the gateway 15. The generator 17 is connected to the gateway 15 of the screed section 10 via a power supply line 18. The electrical power generated by the generator 17 can be distributed to the respective heating elements 11, 12, In of the screed section 10 via the gateway 15 to heat them up individually.

According to FIG. 2, the screed section 10 furthermore has a temperature sensor 19 for detecting an actual temperature of the screed plate 6 of the screed 5. The temperature sensor 19 is connected to the gateway 15. Based on a comparison of the detected actual temperature of the screed plate 6 with a desired temperature value of the screed plate which is determined, for example, with reference to the laying material temperature or is manually adjusted by the screed operator, the controlling system 8, 8' can dynamically control the power supply of the respective heating elements 11, 12, 1*n* installed in the screed section 10.

In FIG. 2, the data line 16 and the power supply line 18 are represented as separate lines. The data line 16 can be present as a CAN bus system. As an alternative, the power supply line 18 is embodied as a PLC line wherein the gateway 15 is configured to modulate the respective actual temperature values of the heating elements 11, 12, 1*n* received from the screed section 10 from the temperature sensors T to the power supply line 18 and to transmit them to the controlling system 8, 8'.

The other screed sections 20, 30 of the heating device 100 have a design comparable to that of the screed section 10.

The screed section 20 comprises at least three heating elements 21, 22, 2*n*, temperature sensors T installed at them and a gateway 25 which receives the respective temperature conditions of the heating elements 21, 22, 2*n* and forwards them to the controlling system 8, 8' for their function diagnosis.

The screed section 30 comprises three heating elements 31, 32, 3*n*, temperature sensors T installed at them, and a gateway 35 which receives the respective temperature conditions of the heating elements 31, 32, 3*n* and forwards them to the controlling system 8, 8' for their function diagnosis.

According to FIG. 2, each screed section 10, 20, 30, in particular each heating element 11, 12, 1*n*, 21, 22, 2*n*, 31, 32, 3*n* installed therein, can be individually checked for its function since temperature conditions are detected at all heating elements 11, 12, 1*n*, 21, 22, 2*n*, 31, 32, 3*n* and are forwarded to the controlling system 8, 8' for their function control by means of the respective gateway 15, 25, 35, optionally in a processed form. A defective heating element 11, 12, 1*n*, 21, 22, 2*n*, 31, 32, 3*n* including its place of installation can be displayed by means of the display device D, D'.

FIG. 2 furthermore shows an ambient temperature sensor 40 which is embodied or configured to detect an ambient temperature in the region of the screed 5. The ambient temperature sensor 40 is connected to the controlling system 8, 8'. Based on the ambient temperature detected by means of the ambient temperature sensor 40, the required heat-up duration until the desired temperature of the screed plate 6 is reached can be determined by the controlling system 8, 8' and optionally displayed to the operator.

FIG. 2 furthermore shows a desired temperature value S which the controlling system 8, 8' determines for all heating elements 11, 12, 1*n*, 21, 22, 2*n*, 31, 32, 3*n* based on heat-up rates measured thereat and employs during the function diagnosis of the heating elements 11, 12, 1*n*, 21, 22, 2*n*, 31, 32, 3*n*.

Figure 3:
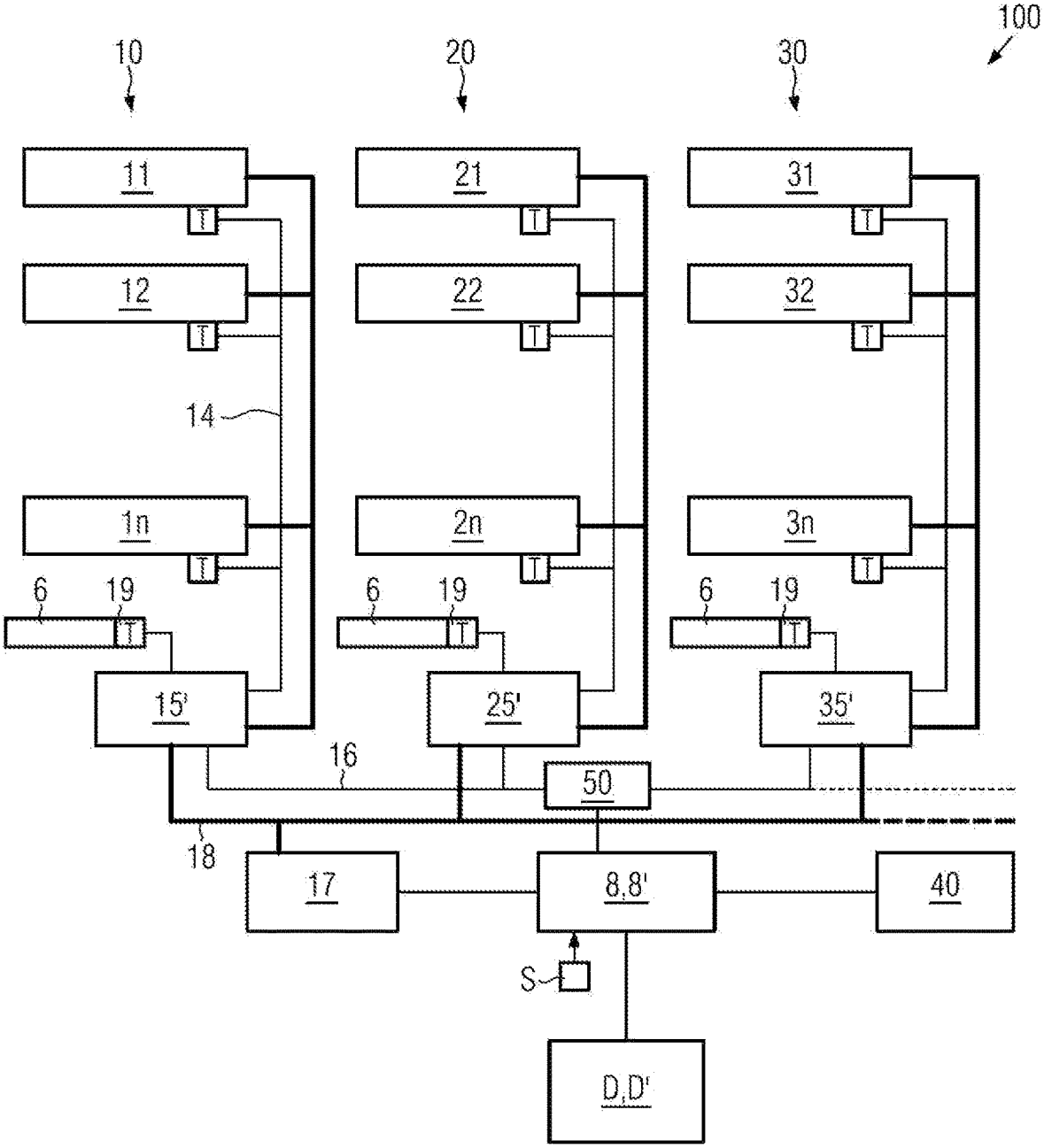
FIG. 3 shows a schematic representation of a heating device according to the embodiment for the road finishing machine according to the disclosure.

FIG. 3 shows a slightly modified embodiment compared to FIG. 2. FIG. 3 shows that the screed section 10 includes a screed distributor 15', the screed section 20 a screed distributor 25', and the screed section 30 a screed distributor 35', the respective screed distributors 15', 25', 35' being connected to the controlling system 8, 8' by a gateway 50 shared by them.

As those skilled in the art will understand, the controlling system 8, 8', gateways 15, 25, 35, 50, distributors 15', 25', 35', display D, D', as well as any other controller, unit, component, module, system, subsystem, interface, sensor, device, or the like described herein may individually, collectively, or in any combination comprise appropriate circuitry, such as one or more appropriately programmed processors (e.g., one or more microprocessors including central processing units (CPU)) and associated memory, which may include stored operating system software, firmware, and/or application software executable by the processor(s) for controlling operation thereof and for performing the particular algorithm or algorithms represented by the various methods, functions and/or operations described herein, including interaction between and/or cooperation with each other. One or more of such processors, as well as other circuitry and/or hardware, may be included in a single Application-Specific Integrated Circuit (ASIC), or several processors and various circuitry and/or hardware may be distributed among several separate components, whether individually packaged or assembled into a System-on-a-Chip (SoC).

What is claimed is:

1. A road finishing machine comprising:

a screed embodied to produce a road pavement and including a heating device with a plurality of heating elements;

at least one generator for supplying the heating device with electrical power; and a controlling system embodied to activate the at least one generator;

wherein each of the plurality of heating elements has at least one temperature sensor employed for detecting a malfunction occurring thereat;

wherein the controlling system is embodied to identify, based on respective temperature gradients detected by means of the temperature sensors embodied at the heating elements, a respective heating element type of each of the heating elements, and based thereon to determine respective desired temperature values used for the diagnosis of errors for the heating elements.

2. The road finishing machine according to claim 1, wherein each temperature sensor is connected to the controlling system by a gateway configured for signal processing, or each temperature sensor is connected to a screed distributor designed to receive and forward actual temperature values detected by each temperature sensor.

3. The road finishing machine according to claim 2, wherein the screed distributor is embodied to forward the actual temperature values of the respective heating elements received thereat to a gateway configured for signal processing and connected to the controlling system.

4. The road finishing machine according to claim 3, wherein the screed includes a plurality of screed sections each including a plurality of heating elements and a gateway configured for signal processing and connecting temperature sensors provided thereat with the controlling system, or each including a plurality of heating elements and one screed distributor.

5. The road finishing machine according to claim 1, wherein all heating elements of the heating device include at least one temperature sensor integrally embodied thereat.

6. The road finishing machine according to claim 1, wherein the temperature sensors are each connected to the gateway or to the screed distributor by a plug connection.

7. The road finishing machine according to claim 1, wherein the gateway or the screed distributor are embodied as a power line communication (PLC) gateway.

8. The road finishing machine according to claim 1, wherein the respective gateway or screed distributor is connected to the controlling system by a power line communication (PLC) line or by a separate data bus system.

9. The road finishing machine according to claim 1, wherein the controlling system is embodied, for carrying out a diagnosis of errors of the respective heating elements, to compare the respective desired temperature values determined for the heating elements with actual temperature values detected thereat.

10. The road finishing machine according to claim 1, wherein the controlling system is embodied to identify, on the basis of at least one determined heating element type, a screed part which includes the same.

11. The road finishing machine according to claim 1, wherein the controlling system is embodied to identify, on the basis of at least one determined heating element type, a screed paving width.

12. The road finishing machine according to claim 1, wherein the gateway or the screed distributor is configured to supplement actual temperature values of the heating elements detected by the respective temperature sensors by one piece of information each with respect to their place of measurement and to forward them to the controlling system as actual temperature-place data for diagnosis purposes.

13. The road finishing machine according to claim 1, wherein the screed comprises at least one screed plate, wherein the controlling system is configured to determine a desired temperature value of the screed plate on the basis of a detected actual temperature value of the paving material used by the road finishing machine supplied to it, and to compare it with a detected actual temperature of the screed plate in order to activate, based thereon, a power supply of one or more heating elements associated with the screed plate.

14. The road finishing machine according to claim 13, wherein the controlling system is configured to determine, on the basis of a detected ambient temperature supplied to it, a heat-up duration of the heating element employed for heating the screed plate remaining for reaching the desired temperature value of the screed plate.

15. A road finishing machine comprising:

a screed configured to produce a road pavement and including a heating device having a plurality of heating elements; and a controlling system configured to activate a generator to supply the heating device with electrical power;

wherein each of the plurality of heating elements has a temperature sensor configured to detect a temperature at its respective heating element for determining a malfunction at the heating element;

wherein the controlling system is embodied to identify, based on respective temperature gradients detected by means of the temperature sensors embodied at the heating elements, a respective heating element type of each of the heating elements, and based thereon to determine respective desired temperature values used for the diagnosis of errors for the heating elements.

16. The road finishing machine according to claim 15, wherein each temperature sensor is connected to the controlling system by a gateway configured for signal processing, or each temperature sensor is connected to a screed distributor designed to receive and forward actual temperature values detected by the temperature sensors.

17. The road finishing machine according to claim 16, wherein the screed distributor is configured to forward the actual temperature values of the respective heating elements received thereat to a gateway configured for signal processing and connected to the controlling system.

* * * * *